US005524978A

United States Patent [19]

Tunis et al.

[11] Patent Number: 5,524,978

[45] Date of Patent: Jun. 11, 1996

[54] SLIDER QUAKE LATCH

[76] Inventors: Robert H. Tunis, 366 Alosta Way, Camarillo, Calif. 93010; Randal R. Schanley, 6845 ½ Hazeltine Ave., Van Nuys, Calif. 91405

[21] Appl. No.: 385,784

[22] Filed: Feb. 9, 1995

[51] Int. Cl.[6] ..... E05B 65/44; E05B 3/00; E05C 3/10

[52] U.S. Cl. ..... 312/216; 312/333; 312/215; 312/222; 292/DIG. 61; 292/DIG. 55; 292/341.15; 292/341.17

[58] Field of Search ..... 312/216, 222, 312/215, 333, 332.1; 292/341.15, 341.17, 198, DIG. 55, DIG. 61

[56] References Cited

U.S. PATENT DOCUMENTS

| | | | |
|---|---|---|---|
| 300,334 | 6/1884 | Wuest | 292/DIG. 61 X |
| 2,141,088 | 12/1938 | McFarlane | 292/DIG. 61 X |
| 3,311,394 | 3/1967 | Nardozza | 292/341.17 X |
| 3,866,730 | 2/1975 | Balducci | 292/DIG. 61 X |
| 4,085,985 | 4/1978 | Weber | 312/216 |
| 4,108,516 | 8/1978 | Scholl | 312/216 |
| 4,416,413 | 11/1983 | Chester | 312/215 X |
| 5,263,749 | 11/1993 | Errani | 292/DIG. 61 X |
| 5,338,109 | 8/1994 | Haines | 312/215 X |

*Primary Examiner*—Peter M. Cuomo
*Assistant Examiner*—Robert J. Sandy

[57] ABSTRACT

The latch assembly disclosed provides a cabinet latch that is both earthquake and child resistant, but which is easy for an adult to open. This assembly can be used on cabinet doors of differing lengths and configurations.

1 Claim, 3 Drawing Sheets

FIG. 1
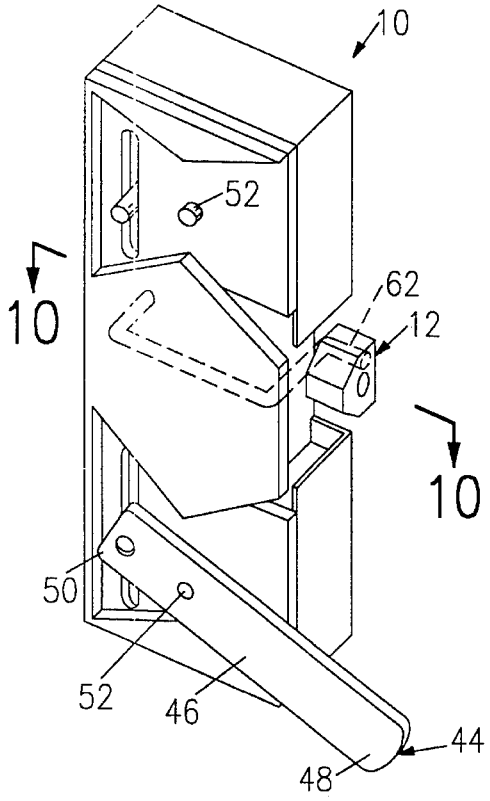
FIG. 2
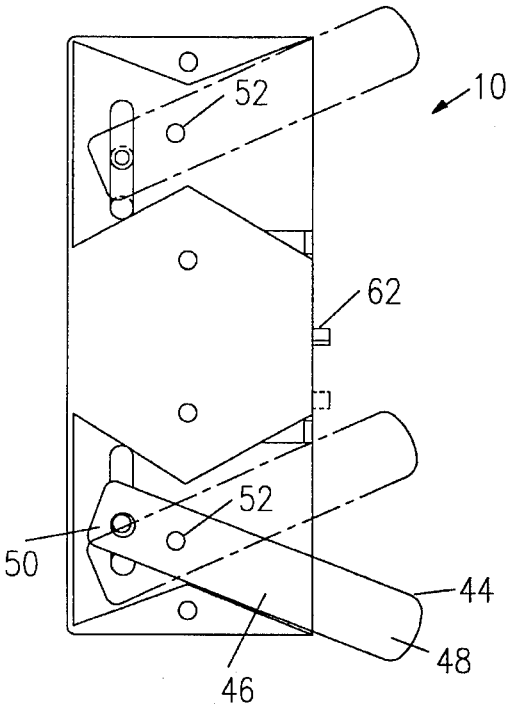
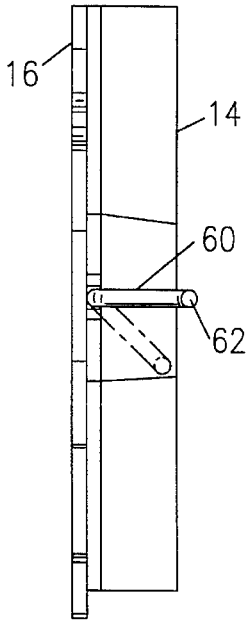
FIG. 4
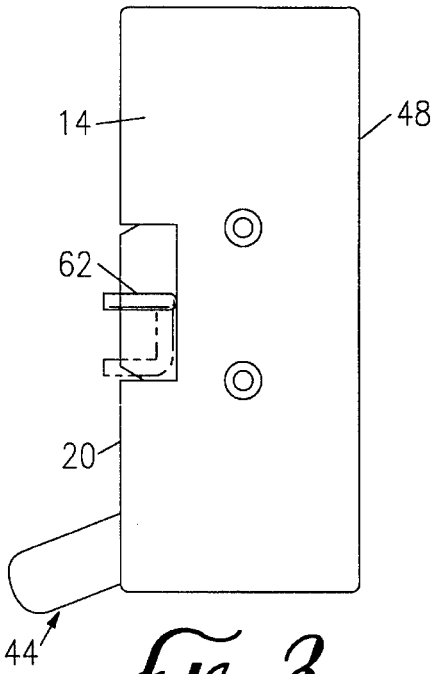
FIG. 3
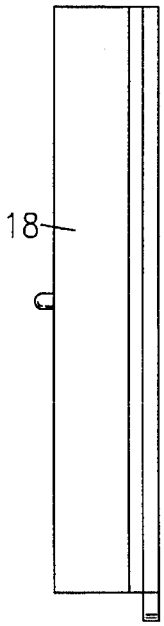
FIG. 5

SLIDER QUAKE LATCH

This invention relates to a two part latch assembly for mounting within a cabinet. The first part of the assembly is attached to the inside of the cabinet door, and the second part is mounted on the interior of the cabinet so that the two parts of the assembly cooperate to keep the door closed when the cabinet door is shut.

BACKGROUND

Earthquakes in California, Japan, Mexico and elsewhere cause an enormous loss in personal property damage. Much personal property, such as fine china and collectibles, is broken when it is thrown out of its storage cabinet to break upon impact with the floor. Objects falling out of cabinets during an earthquake may act as projectiles and injure people nearby. Keeping cabinet doors closed during earthquakes is therefore desirable to protect both breakable items and people.

Another feature of earthquake resistant latches is that such doors are often child resistant. Typically, infants and toddlers are unable to open doors that require more than a simple tug or pull on the door handle to open the cabinet. Latches that require more than pulling on the handle to open the door therefore can function as child resistant latches.

Several latches designed to keep cabinet doors closed during earthquakes are now marketed. However, all have design features that interfere with ease of use. One such latch currently sold requires either a two-step or two-handed operation. First, the cabinet door is opened slightly with one hand to enable the other hand to be inserted into the cabinet. Then, while the door is held open with the first hand, the second hand disengages the door-mounted latch from the cabinet-mounted striker. Other models of earthquake resistant latches employ a clip mounted on the cabinet door that either clips around or through appropriately shaped strikers mounted within the cabinet. However, cabinet doors held shut using these latches are opened by a firm tug or pull on the cabinet's door knob, and so can be forced open from the inside by the impact of plates or other household objects being flung against the inside of the cabinet door during an earthquake.

SUMMARY OF THE INVENTION

It is an object of the invention to provide a latch assembly that is earthquake resistant yet easy for an adult to open. It is a further object of the invention to provide a latch assembly that can be used on cabinet doors of differing lengths and configurations. It is a still further object of the invention to provide a child resistant lock.

DRAWINGS

These and other features, aspects and advantages of the present invention will become better understood with reference to the following description, appended claims, and accompanying drawings, where:

FIG. 1 is a perspective view of the back of an earthquake cabinet latch incorporating features of the invention.

FIG. 2 is a back view of the earthquake cabinet latch of FIG. 1 incorporating features of the invention.

FIG. 3 is a front view of the earthquake cabinet latch of FIG. 1 incorporating features of the invention.

FIG. 4 is a right side view of the earthquake cabinet latch of FIG. 1 incorporating features of the invention.

FIG. 5 is a left side view of the earthquake cabinet latch of FIG. 1 incorporating features of the invention.

DETAILED DESCRIPTION

Figure 6:
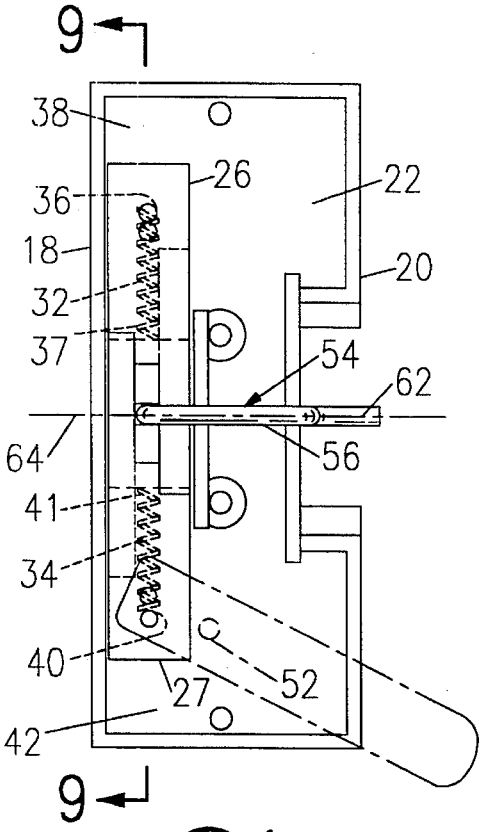
FIG. 6 is a front cutaway view of the earthquake cabinet latch of FIG. 1 incorporating features of the invention.

The invention comprises a latch assembly for mounting within a cabinet. A first portion of the assembly 10 is attachable to a surface of a door in the cabinet, and a second portion of the assembly 12 is mounted onto the cabinet in an area adjacent to the surface of the door. The first and second portions cooperate to hold the door in a closed position in relationship to the cabinet.

As illustrated in FIGS. 1 through 5, the first portion 10 of the assembly comprises a first rectangular surface 14 adapted to lie against an inner surface of a door. A second rectangular surface 16 is parallel to the first surface 14 and spaced therefrom. A first depending side 18 and a second depending side 20 are perpendicular to and connect the longer edges of the first 14 and second 16 rectangular surfaces.

Figure 7:
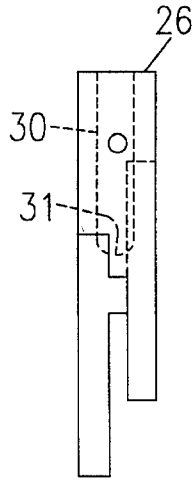
FIG. 7 is a front view of one slider used in the earthquake cabinet latch of FIG. 1.
Figure 8:
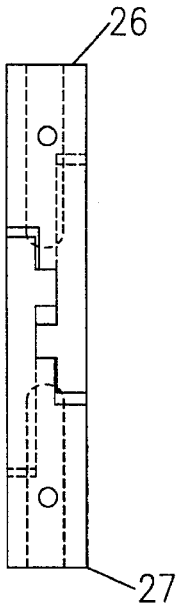
FIG. 8 is a front view of a pair of sliders used in the earthquake cabinet latch of FIG. 1.
Figure 9:
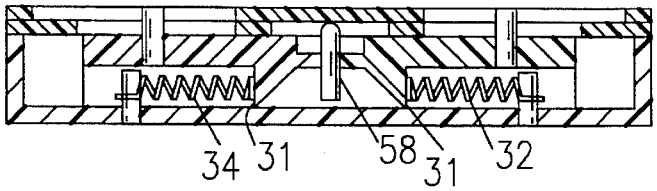
FIG. 9 is a cross section view of the invention taken at line 9—9 of FIG. 6.
Figure 10:
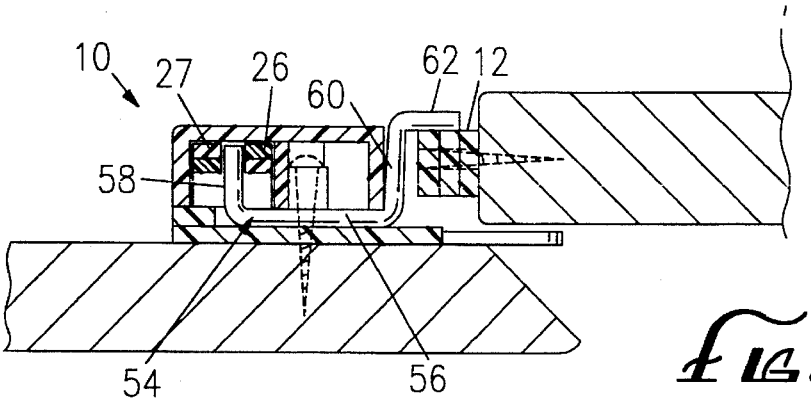
FIG. 10 is a cross section of the invention taken at line 10—10 of FIG. 1.
Figure 11:
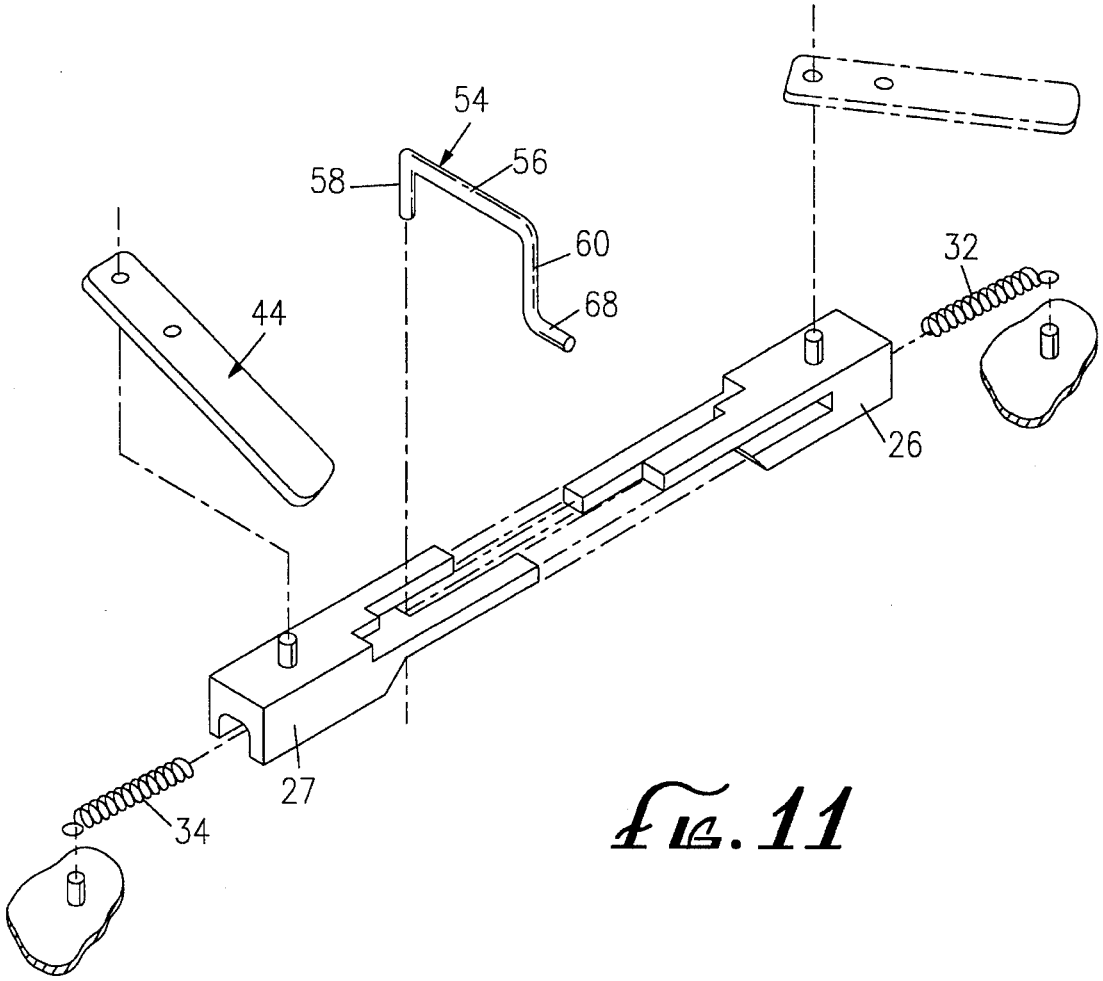
FIG. 11 is an exploded view of the assembly showing pairs of slides, levers, springs and spring attachment points.

As illustrated in FIGS. 6–11, a hollow enclosure 22 is formed by the interconnection of the first and second rectangular surfaces 14, 16 with the first and second depending sides 18, 20. The hollow enclosure 22 comprises a space for receiving a pair of independent but coacting slides 26, 27. These slides 26, 27 are adapted to move longitudinally in a cooperative manner. The coacting slides 26, 27 move along a defined portion 28 of the hollow enclosure 22 adjacent the first depending side 18.

Each slide 26, 27 has an elongated slot 30 formed in its bottom surface, the slot 30 having at least one closed end 31. A first spring 32 and a second spring 34 cooperate to move the slides 26, 27, longitudinally along the defined portion 28.

The first spring 32 has a first end 36 attached at a first point 38 of the defined portion of the enclosure 28. Similarly, the second spring 34 has its first end 40 attached at a second point 42 of the defined portion of the enclosure 28. These points of attachment 38, 42 are spaced apart such that the springs 32, 34 lie along a straight path with a second end of each spring 37, 41 positioned closer to each other than the first end of each spring 36, 40. The first spring 32 is positioned in the slot 30 in the first slide 26, and the second spring 34 is positioned in the slot 30 in the second slide 27. The second end of each spring 37, 41 impinges on the closed end 31 of each respective enclosing slot 31 when the spring 32, 34 is under compression.

A lever 44 having a central portion 46 is rotationally connected to the second rectangular surface 16 at a pivot point 52. The lever 44 is free to rotate around the pivot point 52 in a plane parallel to the second rectangular surface 16. The lever 44 can be mounted in either one of two positions so that the orientation of the latch assembly can be reversed. FIG. 2 illustrates the alternate positions of the lever 44.

The lever 44 has a first end 48 extending in said plane outward of the second depending side 20 and a second end 50 rotationally attached to the slide 26 at a post 23. Movement from a resting position of the lever first end 48 in the plane of operation of the lever 44 causes the slide 26 to move longitudinally within the enclosure 22. Such movement further compresses the spring 32 such that, on release of the lever 44, the compressed spring 32 causes the slide 26 and lever 44 to return to their resting positions. Similarly, the location of the lever on the second pivot point 52 in connection with the second slide 27 allows for movement of the second slide 27 as described above for the first slide 26.

A C-shaped rod 54 has a central portion 56, a top portion 58, a bottom portion 60, and a latching portion 62. The C-shaped rod 54 is itself positioned along the plane of the second rectangular surface 16. Its top portion 58 is perpendicular to the central portion 56, parallel to the first depending side 18, and is positioned between the two slides 26, 27. Its bottom portion 60 is perpendicular to the central portion 56, parallel to the top portion 58 and adjacent the second side 20. The latch portion 62 is attached to the bottom portion 60. This latch portion 62 is alternatively positioned in a latching mode in the plane of the first rectangular surface 14 when the lever in the rest position, and an open mode wherein the latch portion 62 is rotated around an axis 64 through the center of the central portion 56 away from said plane of the first rectangular surface 14.

A stackable striker 12 for mounting to a cabinet comprises the second portion of the latch assembly. The latch portion 62 of the rod 54 is positioned to engage with the stackable striker 12 when the lever 44 is in the rest position, and to disengage from the stackable striker 12 when the lever 44 is activated and the latching portion 62 is in its open mode. The rod 54 is positioned within the enclosure 22 such that when the enclosure 22 is mounted to a cabinet door only the latching portion 62 of the rod 54 extends outward of the enclosure 22.

Children unfamiliar with how to properly open a cabinet door secured by the latch assembly of the invention may attempt to pull the door open before moving the lever 44. Such a pull on the door creates a "load" on the latch assembly. The presence of this "load" prohibits movement of the C-shaped rod 54, despite movement of the lever 44 and one of the slides 26 or 27, and therefore the cabinet door cannot be opened if it is pulled on before the lever 44 is activated. This feature contributes to the child resistant properties of the latch assembly of the invention.

What is claimed is:

1. A latch assembly for mounting within a cabinet, a first portion of the assembly being attachable to a surface of a door in the cabinet and a second portion of the assembly being mountable to the cabinet in an area adjacent to the surface of the door, said first portion and second portion cooperating to hold the door in a closed position in relationship to the cabinet, comprising:

a. a first rectangular surface adapted to lie against an inner surface of a door, a second rectangular surface parallel to the first surface and spaced therefrom, and first and second depending sides perpendicular to and connecting the longer edges of the first and second rectangular surfaces to form an elongated hollow enclosure, the hollow enclosure having therein:

i. a space for receiving a pair of independent but coacting slides, the slides adapted to move longitudinally in a cooperative manner along a defined portion adjacent the first side of the rectangular enclosure, each slide having an elongated slot formed in a bottom surface thereof, the slot having at least one closed end, and ii. a first spring and a second spring, the first spring having a first end attached at a first point of the defined portion of the enclosure and the second spring having a first end attached at a second point of the defined portion, the points of attachment being spaced apart such that the springs lie along a straight path with a second end of each spring being positioned closer to each other than the first end of each spring, the first spring being positioned in the slot in the first slide and the second spring being positioned in the slot in the second slide, the second end of each spring impinging on the closed end of each respective enclosing slot with the spring being under compression;

b. a lever having a central portion rotationally connected to the second rectangular surface at a pivot point, the lever being free to rotate around the pivot point in a plane parallel to the second rectangular surface, the lever having a first end extending in said plane outward of the second rectangular surface and a second end rotationally attached to one of the slides such that movement from a rest position of the lever first end in the plane of operation of the lever causes the slide to move longitudinally within the enclosure and further compress at least one of the springs such that on release of the lever the compressed spring causes the slide and lever to return to their rest position;

c. a C-shaped rod having (i) a central portion positioned along the plane of the second rectangular surface, (ii) a top portion perpendicular to the central portion, parallel to the first side and positioned between the two slides, and (iii) a bottom portion perpendicular to the central portion, parallel to the top portion and adjacent the second side, the C-shaped rod further having a latch portion attached to the bottom portion, said latch portion being at a 90 degree angle to the bottom portion, the latch portion alternatively positioned in a latching mode in the plane of the first rectangular surface when the lever is in the rest position and an open mode wherein the latch portion is rotated around an axis through the center of the central portion away from said plane of the first rectangular surface; and d. a striker for mounting to a cabinet, the latch portion of the rod positioned to engage with the striker when the lever is in the rest position and to disengage from the striker when the lever is activated and the latching portion is in its open mode, the rod being positioned within the enclosure such that when the enclosure is mounted to a cabinet door only the latching portion of the rod extends outward of the enclosure.

* * * * *